US011421672B2

(12) United States Patent
Vin Raviv et al.

(10) Patent No.: US 11,421,672 B2
(45) Date of Patent: Aug. 23, 2022

(54) LINEAR PERISTALTIC PUMP WITH PINCH AND COMPRESSION BLOCK ARRANGEMENT

(71) Applicant: Hach Company, Loveland, CO (US)

(72) Inventors: Jordan Vin Raviv, Wellington, CO (US); Nelson E. Dervaes, Fort Collins, CO (US)

(73) Assignee: HACH COMPANY, Loveland, CO (US)

( * ) Notice: Subject to any disclaimer, the term of this patent is extended or adjusted under 35 U.S.C. 154(b) by 116 days.

(21) Appl. No.: 16/704,897

(22) Filed: Dec. 5, 2019

(65) Prior Publication Data

US 2021/0172431 A1 Jun. 10, 2021

(51) Int. Cl.
*F04B 43/12* (2006.01)
*F04B 13/00* (2006.01)
(Continued)

(52) U.S. Cl.
CPC ..... *F04B 43/12* (2013.01); *F04B 13/00* (2013.01); *F04B 43/082* (2013.01); *F04B 53/18* (2013.01)

(58) Field of Classification Search
CPC ..... F04B 43/12; F04B 43/082; F04B 53/18; F04B 13/00; F04B 53/16
(Continued)

(56) References Cited

U.S. PATENT DOCUMENTS 3,839,946 A * 10/1974 Paget ..... F04B 39/066 92/153
4,479,797 A * 10/1984 Kobayashi ..... A61M 5/14228 417/474
(Continued)

FOREIGN PATENT DOCUMENTS

FR 2492902 A1 4/1982
JP 8021352 A 1/1996
(Continued)

OTHER PUBLICATIONS

Plastics Today, "Molded peristaltic pump is inexpensive, micro", Plastics Today—Community for Plastics Professionals, Feb. 23, 2012, 2 pages, Accessed on Jul. 31, 2019.
(Continued)

*Primary Examiner* — Nathan C Zollinger
(74) *Attorney, Agent, or Firm* — Ference & Associates LLC

(57) ABSTRACT

An embodiment provides a self-lubricating linear peristaltic pump for delivering precise volumes of fluid, including: a housing comprising a slide area; at least one pinch block located within the slide area of the housing, wherein the at least one pinch block comprises a base end and a face end; a plurality of compression blocks located within the slide area of the housing, wherein each of the plurality of compression blocks comprises a base end and a face end; a cam located within the housing, wherein the mechanically contacts the base end of each of the at least one pinch block and the base end of each of the plurality of compression blocks;
(Continued)

a motor mechanically coupled to the cam, wherein the motor moves the cam upon operation of the motor; and at least one tube in contact with the face end of each of the at least one pinch block and the face end of each of the plurality of compression blocks. Other aspects are described and claimed.

20 Claims, 3 Drawing Sheets

(51) Int. Cl.
*F04B 43/08* (2006.01)
*F04B 53/18* (2006.01)

(58) Field of Classification Search
USPC ..... 417/474, 477.1
See application file for complete search history.

(56) References Cited

U.S. PATENT DOCUMENTS 4,650,469 A * 3/1987 Berg ..... A61M 5/142 417/474
4,653,987 A * 3/1987 Tsuji ..... F04B 43/082 128/DIG. 12
4,755,109 A * 7/1988 Botts ..... F04B 43/082 29/453
5,290,158 A * 3/1994 Okada ..... F04B 43/082 417/474
5,522,799 A 6/1996 Furukawa
5,924,852 A 7/1999 Moubayed et al.
6,033,060 A 3/2000 Minami
6,685,450 B2 2/2004 Bandis et al.
8,371,832 B2 * 2/2013 Rotem ..... F04B 43/1253 417/477.7
8,535,025 B2 * 9/2013 Rotem ..... A61M 5/142 417/477.1
2012/0100023 A1 4/2012 Hanazuka et al.
2012/0257986 A1 10/2012 Momeni
2015/0182697 A1 7/2015 Panzer
2017/0350389 A1 12/2017 Quintarelli et al.
2018/0045051 A1 2/2018 Hahn et al.
2019/0186484 A1 6/2019 Miller

FOREIGN PATENT DOCUMENTS

WO WO-9847551 A1 * 10/1998 ..... F04B 43/088
WO 2004033903 A2 4/2004

OTHER PUBLICATIONS

International Searching Authority, Notification of Transmittal Of the International Search Report and the Written Opinion of the International Searching Authority, of the Declaration, dated Feb. 3, 2021, pp. 18.

* cited by examiner

LINEAR PERISTALTIC PUMP WITH PINCH AND COMPRESSION BLOCK ARRANGEMENT

FIELD

This application relates generally to pumps, and, more particularly, to peristaltic pumps.

BACKGROUND

Peristaltic pumps may be used to pump fluids. The fluid may be in a tube. The pump may compress the tube and cause the movement of fluid through the tube. Peristaltic pumps may be used in medical, agricultural, industrial, laboratory, food preparation, or the like. The movement of fluid in the tube may be controlled by the peristaltic pump. The movement may be metered such that an amount of the fluid is moved. A peristaltic pump may be used in an environment in which air or turbulence cannot be introduced into the fluid.

BRIEF SUMMARY

In summary, one embodiment provides a self-lubricating linear peristaltic pump for delivering precise volumes of fluid, comprising: a housing comprising a slide area; at least one pinch block located within the slide area of the housing, wherein the at least one pinch block comprises a base end and a face end; a plurality of compression blocks located within the slide area of the housing, wherein each of the plurality of compression blocks comprises a base end and a face end; a cam located within the housing, wherein the mechanically contacts the base end of each of the at least one pinch block and the base end of each of the plurality of compression blocks; a motor mechanically coupled to the cam, wherein the motor moves the cam upon operation of the motor; and at least one tube in contact with the face end of each of the at least one pinch block and the face end of each of the plurality of compression blocks.

Another embodiment provides a method for moving precise volumes of fluid using a self-lubricating peristaltic pump, comprising: introducing a fluid into at least one tube in contact with a face end of each of at least one pinch block and a face end of each of a plurality of compression blocks, located within a housing of the self-lubricating peristaltic pump; and moving the fluid, using the self-lubricating peristaltic pump comprising: a housing comprising a slide area; at least one pinch block located within the slide area of the housing, wherein the at least one pinch block comprises a base end and a face end; a plurality of compression blocks located within the slide area of the housing, wherein each of the plurality of compression blocks comprises a base end and a face end; a cam located within the housing, wherein the mechanically contacts the base end of each of the at least one pinch block and the base end of each of the plurality of compression blocks; a motor mechanically coupled to the cam, wherein the motor moves the cam upon operation of the motor; and at least one tube in contact with the face end of each of the at least one pinch block and the face end of each of the plurality of compression blocks.

A further embodiment provides a product for a self-lubricating linear peristaltic pump for delivering precise volumes of fluid, comprising, comprising: a housing comprising a slide area; at least one pinch block located within the slide area of the housing, wherein the at least one pinch block comprises a base end and a face end; a plurality of compression blocks located within the slide area of the housing, wherein each of the plurality of compression blocks comprises a base end and a face end; a cam located within the housing, wherein the mechanically contacts the base end of each of the at least one pinch block and the base end of each of the plurality of compression blocks; a motor mechanically coupled to the cam, wherein the motor moves the cam upon operation of the motor; at least one tube in contact with the face end of each of the at least one pinch block and the face end of each of the plurality of compression blocks a processor; and a storage device having code stored therewith, the code being executable by the processor and comprising: code that controls fluid movement in the at least one tube, wherein the at least one tube is in contact with the face end of each of the at least one pinch block and the face end of each of the plurality of compression blocks, wherein the fluid movement is facilitated by: code that moves the at least one pinch block and the plurality of compression blocks by mechanical contact with the cam, wherein the plurality of compression blocks slide in a sequence to pass the fluid in the at least one tube; and code that rotates the cam using the motor.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
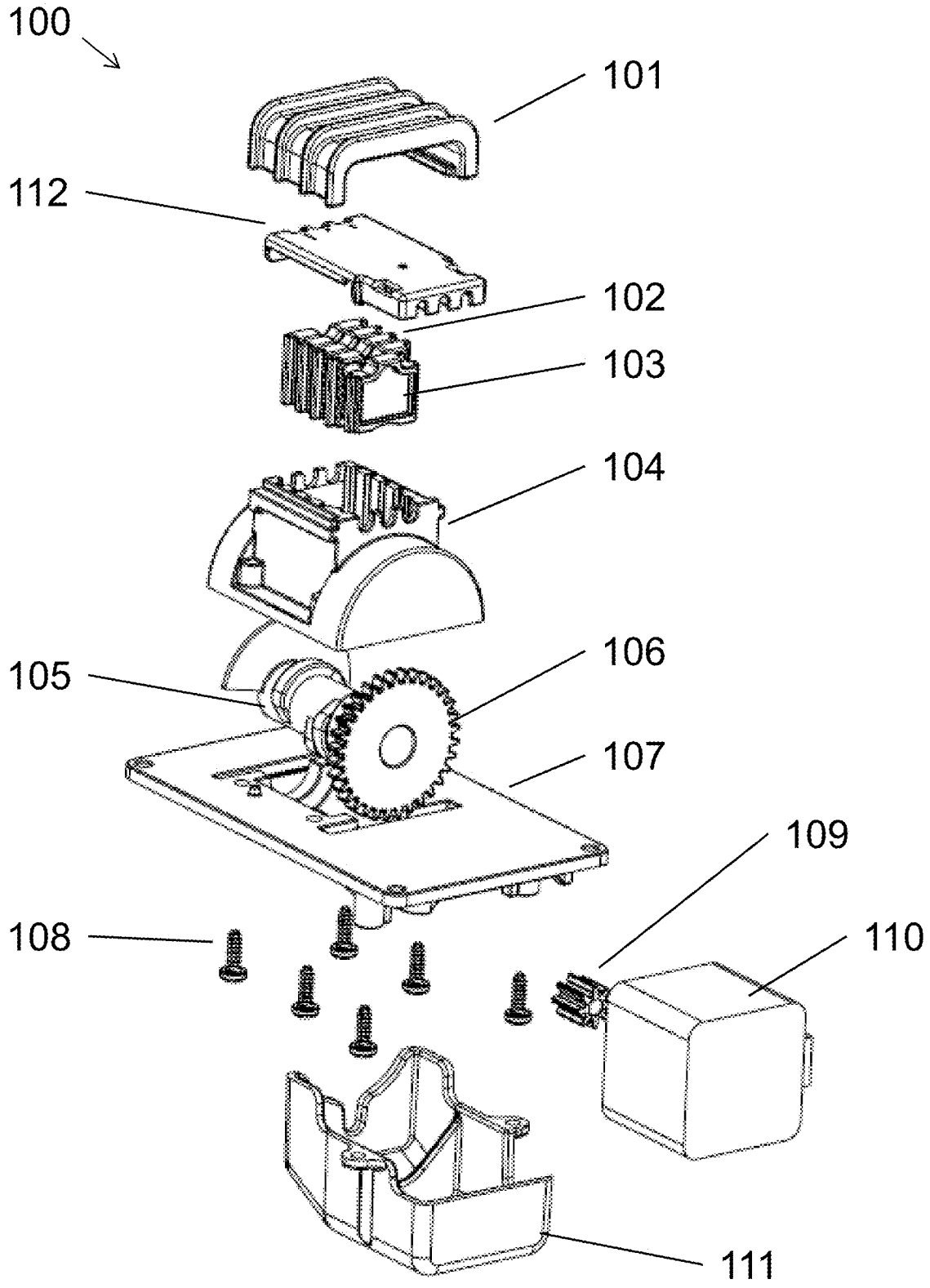
FIG. 1 illustrates an example embodiment of a peristaltic pump.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well-known structures, materials, or operations are not shown or described in detail. The following description is intended only by way of example, and simply illustrates certain example embodiments.

Conventional methods and systems for peristaltic pumps may be of the roller type. A fluid may be contained in a flexible tube. A fluid may be moved or displaced by movement of a roller against the flexible tube. For example, a flexible tube containing a fluid may be wrapped around a roller. The roller on the outside circumference of a shaft turns and compresses the tube and the fluid contained therein. As the roller turns, a portion of the tube becomes compressed, partially occluded, or occluded. The tube may then return to an uncompressed state after the roller passes. The roller may be switched on and off to deliver an amount of fluid.

A linear peristaltic pump uses another method to compress a tube and fluid contained therein. A series of compressions against the tube in an inline manner, as opposed to a rotating roller, creates movement of fluid through the tube. Linear peristaltic pumps may allow for a higher precision of delivery of a measured volume of fluid. In other words, a series of compression against the tubing in a sequential manner may move the fluid through the tube.

Conventional peristaltic pumps may suffer from wear over their lifetimes. For example, peristaltic pumps may be constructed of metal and use ball bearings. The ball bearings may be located at wear points, for example, in a location where a shaft passes through a plate. This construction method has drawbacks. For example, metal wears over time. The wearing of metal reduces the tolerances of the pump. A reduced tolerance may reduce the ability of the peristaltic pump to deliver precise volumes of fluid as the service time of the pump increases. Also, ball bearings require maintenance. For example, ball bearings may show signs of wear over time. The wear may be due to dust, liquid intrusion, containments, or breakdown of the bearing races and balls over time. Ball bearings may also require cleaning and lubrication over time. Metal components may corrode, especially in harsh environments with moisture and contaminants. Additionally, ball bearing and metal represent a higher construction cost as quality materials for medical and/or laboratory grade materials may be expensive.

A peristaltic pump made of plastic may reduce cost, maintenance, wear, and the like. A properly selected plastic material may self-lubricate. In this manner, bearings may be reduced or even eliminated from the peristaltic pump design. The pump may be made of fewer materials. The design may also reduce the number of parts. This reduces maintenance issues. The complexity of the peristaltic pump may also be reduced. A pump with fewer parts has fewer points of possible failure. Fewer parts may also reduce manufacturing costs. Plastic manufacturing and molding allows for consistent design and high reliability.

Accordingly, an embodiment provides a device and method for the precise deliver of a fluid in a tube using a self-lubricating peristaltic pump. In particular, the peristaltic pump may be constructed of a plastic material containing one or more components that lubricate moving parts that wear upon one another. The peristaltic pump may have no or very few metal components. The peristaltic pump may have no or very few bearings. The peristaltic pump may be a linear peristaltic pump. In an embodiment, one or more lengths of tubing containing a fluid may be positioned or clamped to the pump. The peristaltic pump may have a plurality of compression blocks and at least one pinch block. A face end of the compression block may compress the tube to move the fluid within the tube. A face end of a pinch block may partially occlude or occlude the tubing and stop flow. In an embodiment, the compression and pinch blocks may slide in a slide area of a housing. The sliding of the block may be in a longitudinal axis from the face end to a base end of the block. The base end of a compression or a pinch block may contact a cam that moves a block in a track or grove. The plastic construction of the peristaltic pump may be self-lubricating. The plastic may contain glass fibers, polycarbonate, silicone, Teflon™, ultra-high-molecular weight polyethylene (UHMW), nylon, polyoxymethylene (POM), polyetheretherketone (PEEK), polybutylene terephthalate (PBT), polytetrafluoroethylene (PTFE), high-density polyethylene (HDPE), or a combination thereof.

The illustrated example embodiments will be best understood by reference to the figures. The following description is intended only by way of example, and simply illustrates certain example embodiments.

Figure 2:
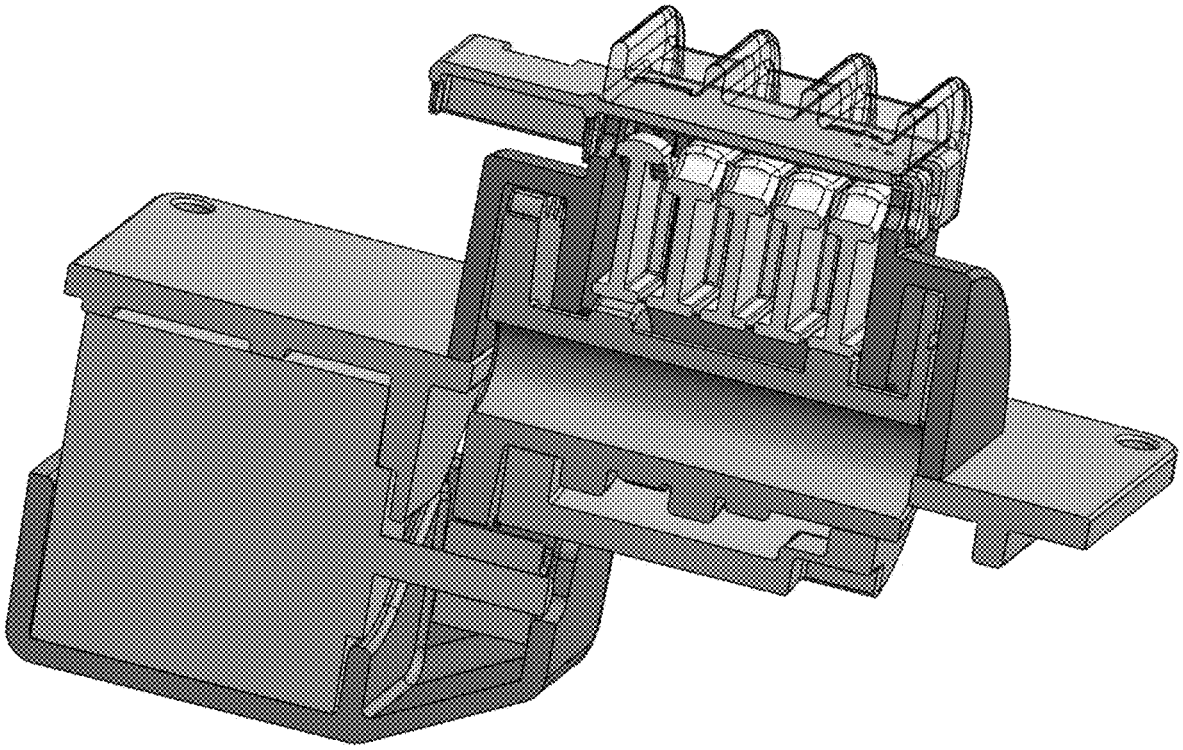
FIG. 2 illustrates an exploded view of an example embodiment of a peristaltic pump.

Referring to FIG. 1, an example device for a self-lubricating linear peristaltic pump is illustrated. FIG. 2 is provided as a cutaway view of an embodiment of the peristaltic pump. The device 100 may be used the movement of a fluid contained in a tube. The peristaltic pump may be used for medical, industrial, laboratory, agricultural, or the like environments. The peristaltic pump may use a plurality of blocks that contact and compress the tube in a sequence to facilitate the movement of a fluid through the tube.

The peristaltic pump may have a cover 101. The cover may be a cover for a slide area of the housing 104. The cover 101 may have a functional purpose. For example, the cover 101 may be removable and serve as a clamp to keep at least one piece of tubing (not pictured) in contact with a plurality of compression blocks 102 and/or an at least one pinch block 103. The tubing may be of a compressible material. The cover 101 may snap or slid into place upon the slide area of a housing 104. Additionally or alternatively, the cover 101 may be affixed with a hinge, latch, fastener, or the like. The cover 101 may snap, swing, click, or the like into a closed position. The cover 101, may be easily opened to allow at least one length of tubing to be placed under the cover. The cover 101, may apply enough force to the tubing to keep it against the plurality of compression blocks 102 and the at least one pinch block 103. The force may be gentle enough such that the at least one piece of tubing is not crimped and/or constricted by the cover 101. In an embodiment, the pump may have a tubing cartridge 112. The tubing cartridge 112 may hold one or more tubes, may allow for easier changing of tubing, and/or align one or more pieces of tubing. The tubing cartridge 112 may be located between the cover 101, and the plurality of compression blocks 102 and the at least one pinch block 103. In an embodiment, tubing cartridge 112 may have indentations aligned with indentations of the slide area of a housing 104 to hold one or more pieces of tubing in place against the faces of the plurality of compression blocks 102 and the at least one pinch block 103. The cover 101 may hold the tubing cartridge 112 in place.

The peristaltic pump may have a plurality of compression blocks 102. The compression block may have a face end and a base end. The face end may be in contact or opposed to at least one piece of tubing. The base end of a compression block may be in contact with or opposed to a cam 105. The face end of a compression block 102 may be shaped or contoured. For example, the face of a compression block 102 may have a semicircular indentation. The semicircular indentation may be beveled around the edges. The semicircular indentation may be of a diameter corresponding to a diameter of a piece of tubing or similar to a piece of tubing. A compression block 102 may be shaped such that the face end compresses the tubing.

A plurality of compression blocks may be present. For example, a plurality of compression blocks may be parallel to one another. The face end of each compression block may compress the tubing in a sequence to facilitate movement of a fluid in a tube. The plurality of compression blocks may move in a sequence or in a different order to cause peristalsis of fluid through the tube. The sequence may be from one compression block to an adjacent block and so forth. Other sequences are possible depending on the use or application of the peristaltic pump.

The peristaltic pump may have at least one pinch block 103. In an embodiment there may be only a single pinch block. The pinch block may stop the flow of a fluid in a tube. The stoppage of fluid may be at a time when the pump is turned off. The pinch block 103 may have a face end and a base end. The face end of a pinch block may be in contact or opposed to at least one piece of tubing. The base end of a pinch block may be in contact with or opposed to a cam 105. The face end of a compression block may be shaped or contoured. For example, the face of a pinch block may have a raised portion on the face end. The raised portion may be beveled around the edges. The raised portion may have dimensions corresponding to a diameter of a piece of tubing or similar to a piece of tubing. A pinch block 103 may be shaped such that the face end compresses and/or occludes the tubing. The pinch block 103 may be retractable. In other words, the pinch block 103 may be moved such that the face end does not contact the tubing while the peristaltic pump is moving fluid through a tube. The pinch block 103 may be moved such that the raise portion occludes or stops the movement of a fluid in the tubing when the pump is stopped or when the flow is shut off.

The peristaltic pump may have a slide area of a housing 104. The slide area is a portion of the housing of the peristaltic pump. The plurality of compression blocks 102 and the at least one pinch block 103, may be partially located in the slide area 104. The slide area 104, may have tracks or grooves. A single track or groove, has a corresponding compression or pinch block. As an analogy, the slide area 104 may be akin to a dresser, and the compression or pinch blocks akin to the drawers in the dresser. Each compression or pinch block may slide in its respective groove or track independently of one another. The number of slides or tracks may be adapted to the use or application of the peristaltic pump. The compression or pinch block may slide in its respective groove or track in an axis from the base end to the face end or each compression or pinch block.

At the base of the slide area 104, the peristaltic pump may have a cam 105. The cam 105 may contact the base end of the plurality of compression blocks 102 and the at least one pinch block 103. The rotation of the cam 105 around its longitudinal axis may cause the plurality of compression blocks 102 and the at least one pinch block 103 to slide in the slide are 104. The sliding of the plurality of compression blocks 102 and the at least one pinch block 103, in turn, cause the face end of each of the plurality of compression blocks 102 and the at least one pinch block 103 to contact the tubing and move fluid through the tube.

The cam 105, may have lobes. Lobes may be raised portions away from the longitudinal centerline of the cam that correspond to each of the compression of pinch blocks. A cam 105 and associated lobes may be selected based upon the desired movement of the compression and pinch blocks. In other words, the lobes of the cam 105, may be indexed to raise and lower a block in a particular order and at a particular time. Different cams and lobe configurations may yield different peristaltic movement of fluid in the tube.

A spur gear 106 may be mechanically coupled to or molded with the cam 105. In other words, to reduce the number of pieces and complexity of the pump, the cam 105, lobes of the cam, spur gear 106, and other associated components may be a single molded piece. The spur gear 106 may mesh with a pinion gear 109. The pinion gear may be mechanically coupled to a motor 110. The number of teeth, diameter, and ratio of the spur 106 and pinion 109 gears may be selected for speed, precision, application, or the like of the peristaltic pump. Gear reduction may allow a smaller and cheaper motor to be used. The motor may be a stepper motor. The motor may have an extended service life as well. This configuration also reducing the number of parts and moving parts as compared to a traditional peristaltic pump.

The peristaltic pump may have a mounting plate 107. The mounting plate may serve to attach the slide area 104 and the cam cover 111 together. Fasteners 108 such as screws, rivets, clips, bolts, plastic pieces, or the like may be used to hold the pieces together. The mounting plate 107 may also be used to place and mount the peristaltic pump a device. For example, the peristaltic pump may be a part of a larger device such as medical, laboratory, diagnostic, or the like equipment.

The peristaltic pump may be mostly constructed from self-lubricating plastic. The plastic may reduce complexity, cost, and required maintenance of the peristaltic pump. The self-lubricating plastic may contain components to reduce wear and lubricate moving parts when in use. For example, the plastic may be glass filled and/or have glass fibers. The plastic may be a polycarbonate. The plastic may be 20% Polytetrafluoroethylene (PTFE). The plastic may contain silicone. The plastic may contain Teflon™. The plastic may be ultra-high-molecular weight polyethylene (UHMW), nylon, polyoxymethylene (POM), polyetheretherketone (PEEK), polybutylene terephthalate (PBT), polytetrafluoroethylene (PTFE), high-density polyethylene (HDPE), or a combination thereof. Other self-lubricating plastic may be used. These ingredients and/or properties of the plastic may provide good wear resistance characteristics. The wear resistance may be more pronounced as pieces wear against one another. The design of the peristaltic pump with self-lubricating parts, smaller motor, and precise movement of the compression and pinch blocks allows a very precise delivery of a volume of fluid from the tubing.

The system and method may determine the proper volume, rate of delivery, type of fluid, or like. The system may have flow sensors, fluid level sensors, pressure sensor, or any sensor to determine a volume or rate of flow of a fluid. Additionally or alternatively, the peristaltic pump may be calibrated. For example, the system may be programmed that given certain parameters, one cycle of the peristaltic pump delivers a certain volume of a fluid. The parameters may include tubing diameter, fluid viscosity, peristaltic pump speed, or the like. The sensors may be located upstream, downstream, or with in the peristaltic pump unit. The sensors may provide feedback to a system and/or the pump to regulate the delivery of a fluid. The system may also monitor and measure the flow of a plurality of tubes that may deliver fluid.

Measurement of the delivery of a fluid may be at periodic intervals set by the user or preprogrammed frequencies in the device. A measurement of the delivery of a fluid may be an output upon a device in the form of a display, printing, storage, audio, haptic feedback, or the like. Alternatively or additionally, the output may be sent to another device through wired, wireless, fiber optic, Bluetooth®, near field communication, or the like. An embodiment may use an alarm to warn of a measurement or fluid delivery outside acceptable levels. An embodiment may use a system to shut down the peristaltic pump or alter the peristaltic pumping during periods of unacceptable parameters, parameters, or thresholds. For example, a measuring device may use a relay coupled to an electrically actuated valve, or the like. As another example, the system and method may have an automated release of a clamp on the tubing. The automated release may be a solenoid, shift the cover 101, relax the tubing compression of the like. The automated release may release compression on one or more of the pieces of tubing, and may be activated when the system is stagnant for a period of time.

If the fluid delivery is outside acceptable parameters, the system may take corrective action. For example, the system may provide an input to the peristaltic pump to increase speed, increase volume, increase pressure, or the like. In an embodiment, a peristaltic pump may be switched to a faster pumping state to increase pressure, flow, volume, or the like.

Additionally or alternatively, the system may output an alarm, log an event, or the like. An alert may be in a form of audio, visual, data, storing the data to a memory device, sending the output through a connected or wireless system, printing the output or the like. The system may log information such as the measurement location, a corrective action, geographical location, time, date, number of measurement cycles, rate of flow, volume of fluid, a log of the type of fluid being delivered, or the like. The alert or log may be automated, meaning the system may automatically output whether a correction was required or not. The system may also have associated alarms, limits, or predetermined thresholds. For example, if fluid delivery reaches or falls below a threshold or limit. Alarms or logs may be analyzed in real-time, stored for later use, or any combination thereof.

The various embodiments described herein thus represent a technical improvement to conventional peristaltic pump techniques. Using the techniques as described herein, an embodiment may use a method and device for peristaltic pumps. This is in contrast to conventional methods with limitations mentioned above. Such techniques provide a better method to construct and operate peristaltic pumps.

Figure 3:
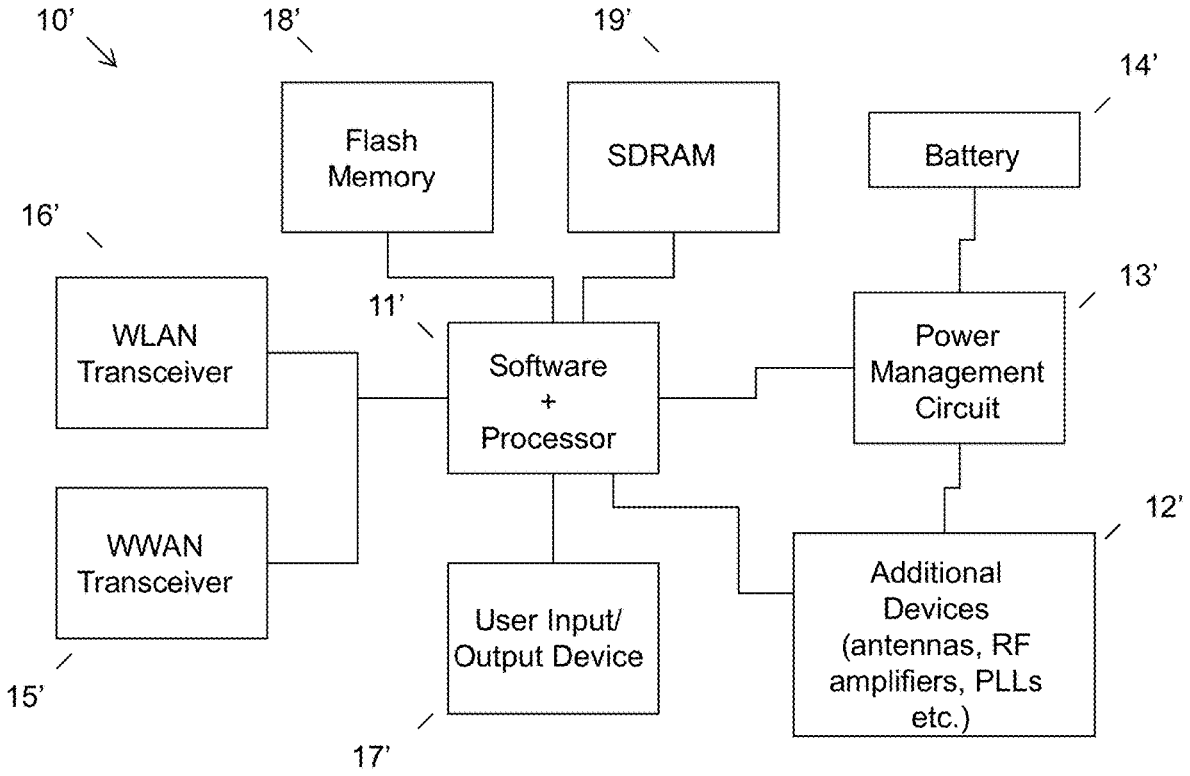
FIG. 3 illustrates an example of computer circuitry.

While various other circuits, circuitry or components may be utilized in information handling devices, with regard to a peristaltic pump according to any one of the various embodiments described herein, an example is illustrated in FIG. 3. Device circuitry 10' may include a measurement system on a chip design found, for example, a particular computing platform (e.g., mobile computing, desktop computing, etc.) Software and processor(s) are combined in a single chip 11'. Processors comprise internal arithmetic units, registers, cache memory, busses, I/O ports, etc., as is well known in the art. Internal busses and the like depend on different vendors, but essentially all the peripheral devices (12') may attach to a single chip 11'. The circuitry 10' combines the processor, memory control, and I/O controller hub all into a single chip 11'. Also, systems 10' of this type do not typically use SATA or PCI or LPC. Common interfaces, for example, include SDIO and I2C.

There are power management chip(s) 13', e.g., a battery management unit, BMU, which manage power as supplied, for example, via a rechargeable battery 14', which may be recharged by a connection to a power source (not shown). In at least one design, a single chip, such as 11', is used to supply BIOS like functionality and DRAM memory.

System 10' typically includes one or more of a WWAN transceiver 15' and a WLAN transceiver 16' for connecting to various networks, such as telecommunications networks and wireless Internet devices, e.g., access points. Additionally, devices 12' are commonly included, e.g., a transmit and receive antenna, oscillators, PLLs, etc. System 10' includes input/output devices 17' for data input and display/rendering (e.g., a computing location located away from the single beam system that is easily accessible by a user). System 10' also typically includes various memory devices, for example flash memory 18' and SDRAM 19'.

It can be appreciated from the foregoing that electronic components of one or more systems or devices may include, but are not limited to, at least one processing unit, a memory, and a communication bus or communication means that couples various components including the memory to the processing unit(s). A system or device may include or have access to a variety of device readable media. System memory may include device readable storage media in the form of volatile and/or nonvolatile memory such as read only memory (ROM) and/or random access memory (RAM). By way of example, and not limitation, system memory may also include an operating system, application programs, other program modules, and program data. The disclosed system may be used in an embodiment of a peristaltic pump.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device, where the instructions are executed by a processor. In the context of this document, a storage device is not a signal and "non-transitory" includes all media except signal media.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and products according to various example embodiments. It will be understood that the actions and functionality may be implemented at least in part by program instructions. These program instructions may be provided to a processor of a device, e.g., a hand held measurement device, or other programmable data processing device to produce a machine, such that the instructions, which execute via a processor of the device, implement the functions/acts specified.

It is noted that the values provided herein are to be construed to include equivalent values as indicated by use of the term "about." The equivalent values will be evident to those having ordinary skill in the art, but at the least include values obtained by ordinary rounding of the last significant digit.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A self-lubricating linear peristaltic pump for delivering precise volumes of fluid, comprising:

a housing comprising a slide area;

at least one pinch block located within the slide area of the housing, wherein the at least one pinch block comprises a base end and a face end, wherein the face end of the at least one pinch block comprises a raised protrusion having a width corresponding to the diameter of and to contact at least one tube, wherein the at least one pinch block occludes the at least one tube;

a plurality of compression blocks located within the slide area of the housing, wherein each of the plurality of compression blocks comprises a base end and a face end, wherein the face end of each of the plurality of compression blocks comprises a semicircular indentation of a diameter corresponding to the diameter of and to contact the at least one tube;

a cam located within the housing, wherein the cam mechanically contacts the base end of each of the at least one pinch block and the base end of each of the plurality of compression blocks;

a motor mechanically coupled to the cam, wherein the motor moves the cam upon operation of the motor; and the at least one tube in contact with a face end of each of the at least one pinch block and the face end of each of the plurality of compression blocks.

2. The pump of claim 1, wherein each of the at least one pinch block and the plurality of compression blocks slide in a respective track of the slide area.

3. The pump of claim 1, wherein each of the at least one pinch block and the plurality of compression blocks slide in an axis defined from the base end to the face end of the at least one pinch block and each of the plurality of compression blocks.

4. The pump of claim 1, wherein the at least one pinch block obstructs the fluid in the at least one tube.

5. The pump of claim 1, wherein the plurality of compression blocks slide in a sequence to pass the fluid in the at least one tube.

6. The pump of claim 1, wherein the motor comprises a pinion gear meshed with a spur gear, the spur gear being mechanically coupled to the cam.

7. The pump of claim 1, wherein a combination of the at least one pinch block and at least one of the plurality of compression blocks create a precise volume of fluid within the at least one tube.

8. The pump of claim 1, wherein each of the housing, the at least one pinch block, the plurality of compression blocks, and the cam comprise a self-lubricating plastic.

9. The pump of claim 8, wherein the self-lubricating plastic comprises a polycarbonate plastic.

10. The pump of claim 8, wherein the self-lubricating plastic comprises a glass fiber, silicone, and Teflon™.

11. A method for moving precise volumes of fluid using a self-lubricating peristaltic pump, comprising:

introducing a fluid into at least one tube in contact with a face end of each of at least one pinch block and a face end of each of a plurality of compression blocks, located within a housing of the self-lubricating peristaltic pump; and moving the fluid, using the self-lubricating peristaltic pump comprising:

the housing comprising a slide area;

the at least one pinch block located within the slide area of the housing, wherein the at least one pinch block comprises a base end and the face end, wherein the face end of the at least one pinch block comprises a raised protrusion having a width corresponding to the diameter of and to contact the at least one tube, wherein the at least one pinch block occludes the at least one tube;

the plurality of compression blocks located within the slide area of the housing, wherein each of the plurality of compression blocks comprises a base end in addition to the respective face end, wherein the face end of each of the plurality of compression blocks comprises a semicircular indentation of a diameter corresponding to the diameter of and to contact the at least one tube;

a cam located within the housing, wherein the cam mechanically contacts the base end of each of the at least one pinch block and the base end of each of the plurality of compression blocks;

a motor mechanically coupled to the cam, wherein the motor moves the cam upon operation of the motor; and the at least one tube in contact with the face end of each of the at least one pinch block and the face end of each of the plurality of compression blocks.

12. The method of claim 11, wherein each of the at least one pinch block and the plurality of compression blocks slide in a respective track of the slide area.

13. The method of claim 11, wherein each of the at least one pinch block and the plurality of compression blocks slide in an axis defined from the base end to the face end of the at least one pinch block and each of the plurality of compression blocks.

14. The method of claim 11, wherein the at least one pinch block obstructs the fluid in the at least one tube.

15. The method of claim 11, wherein the plurality of compression blocks slide in a sequence to pass the fluid in the at least one tube.

16. The method of claim 11, wherein the motor comprises a pinion gear meshed with a spur gear, the spur gear being mechanically coupled to the cam.

17. The method of claim 11, wherein a combination of the at least one pinch block and at least one of the plurality of compression blocks create a precise volume of fluid within the at least one tube.

18. The method of claim 11, wherein each of the housing, the at least one pinch block, the plurality of compression blocks, and the cam comprise a self-lubricating plastic.

19. The method of claim 18, wherein the self-lubricating plastic comprises a polycarbonate plastic and an additive selected from the group consisting of: a glass fiber, silicone, and Teflon™.

20. A product for a self-lubricating linear peristaltic pump for delivering precise volumes of fluid, comprising:

a cam, wherein the cam mechanically contacts a base end of each of at least one pinch block and a base end of each of a plurality of compression blocks;

a motor mechanically coupled to the cam, wherein the motor moves the cam upon operation of the motor;

a processor; and a storage device having code stored therewith, the code being executable by the processor and comprising:

code that controls fluid movement in at least one tube, wherein the fluid movement is facilitated by:

code that moves the at least one pinch block and the plurality of compression blocks by mechanical contact with the cam, wherein the plurality of compression blocks slide in a sequence to pass the fluid in the at least one tube, wherein the face end of each of the plurality of compression blocks comprises a semicircular indentation of a diameter corresponding to the diameter of and to contact the at the least one tube, wherein the face end of the at least one pinch block comprises a raised protrusion having a width corresponding to the diameter of and to contact the at least one tube, wherein the at least one pinch block occludes the at least one tube; and code that rotates the cam using the motor.

* * * * *